United States Patent [19]

Burke

[11] Patent Number: 4,952,192

[45] Date of Patent: Aug. 28, 1990

[54] MATERNITY SUPPORT UNDERGARMENT

[76] Inventor: Frances S. Burke, 325 Sunset Dr., Athens, Ga. 30606

[21] Appl. No.: 325,442

[22] Filed: Mar. 20, 1989

[51] Int. Cl.[5] ..... A41C 1/00; A41C 3/00

[52] U.S. Cl. ..... 450/15; 450/7; 450/18; 450/155

[58] Field of Search ..... 450/154, 155, 156, 15, 450/18, 8, 7

[56] References Cited

U.S. PATENT DOCUMENTS

| | | | |
|---|---|---|---|
| 657,133 | 9/1900 | Redick | 450/15 |
| 664,214 | 12/1900 | Golden | 450/15 |
| 683,745 | 10/1901 | Golden | 450/15 |
| 815,933 | 3/1906 | Reed | 450/15 X |
| 865,156 | 9/1907 | Berggren | 450/15 X |
| 903,204 | 11/1908 | Lang | 450/15 |
| 933,610 | 9/1909 | Yanowsky | 450/15 |
| 1,828,015 | 10/1931 | Allebach | 450/155 R |
| 2,250,807 | 7/1941 | Lunney | 450/155 X |
| 2,469,793 | 5/1949 | Siegel | 450/155 |
| 3,273,563 | 9/1966 | Bonang | 450/155 |
| 4,746,318 | 5/1988 | Moyer | 450/7 X |
| 4,822,317 | 4/1989 | Wimmer | 450/18 X |

*Primary Examiner*—Werner H. Schroeder
*Assistant Examiner*—Jeanette E. Chapman
*Attorney, Agent, or Firm*—Wigman & Cohen

[57] ABSTRACT

A support undergarment for use in supporting the body of a woman during pregnancy, especially during the last trimester of pregnancy is disclosed. The undergarment comprises an elongated back panel that extends substantially from the shoulders to the waist of the wearer for supporting the back of the wearer. A first pair of torso encircling straps extends from the opposite sides of an intermediate portion of the back panel. Each torso strap includes a brassiere support cup with a releasable fastener between the cups. A second pair of adjustable straps extends from the opposite sides of the upper portion of the back panel over the shoulders of the wearer. Each shoulder strap connects to one of the first straps adjacent its associated brassiere cup. A third pair of adjustable straps extends from the opposite sides of the lower portion of the back panel and adjustably connect with an abdominal support sling which encircles and supports the lower abdomen of the wearer. The support undergarment provides support for the abdomen, breasts and back of the wearer.

12 Claims, 1 Drawing Sheet

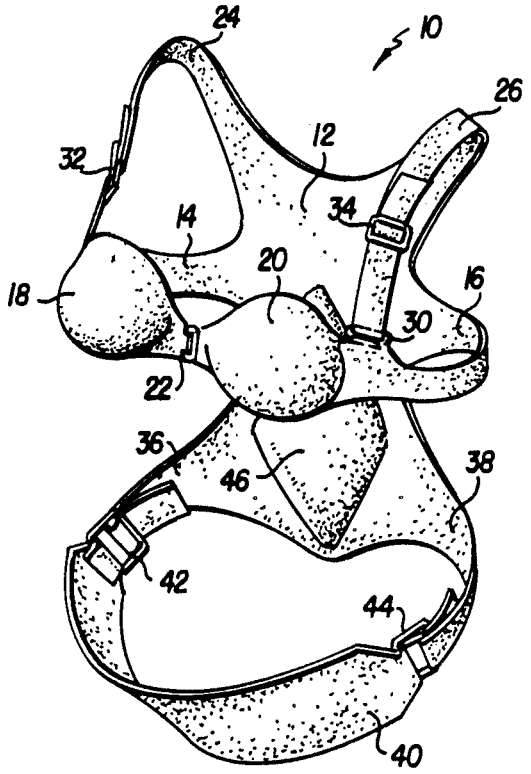
FIG. 1
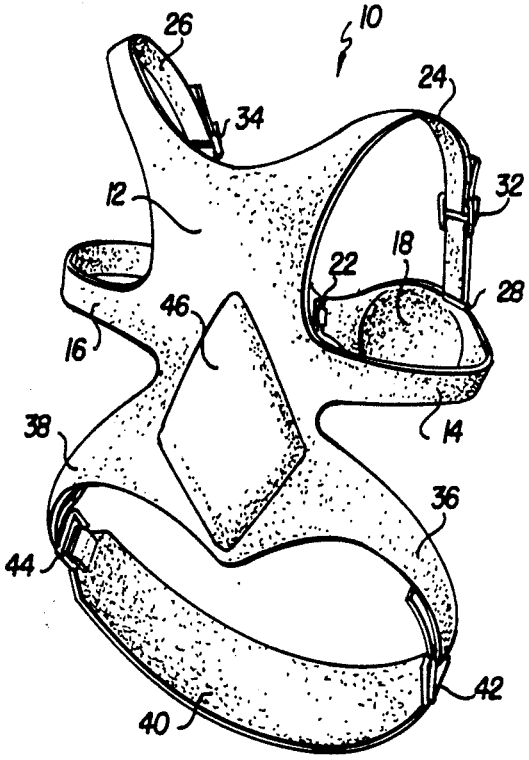
FIG. 2
FIG. 3
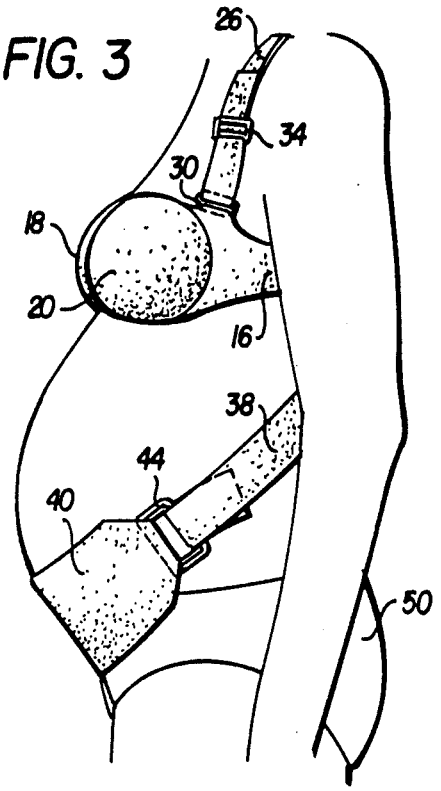
FIG. 4
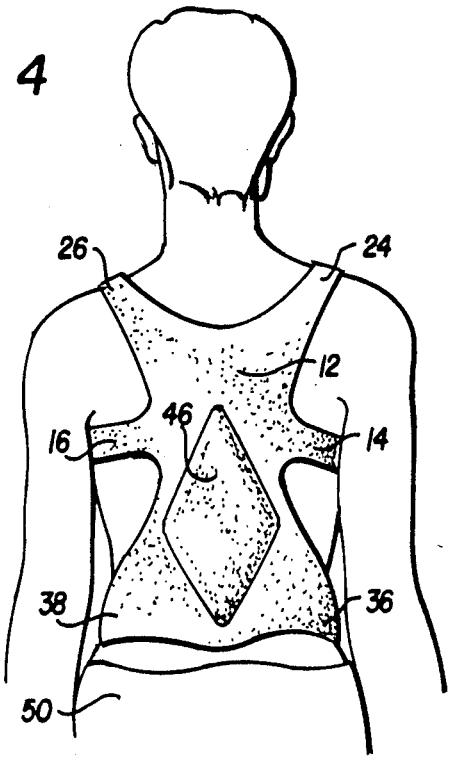

MATERNITY SUPPORT UNDERGARMENT

FIELD OF THE INVENTION

The present invention relates generally to undergarment wearing apparel and more particularly to an undergarment for use by a pregnant woman for supporting the lower abdomen, breasts and lower back and for relieving lower back pressure during pregnancy, and especially during the last trimester of pregnancy.

DESCRIPTION OF THE PRIOR ART

During pregnancy, especially during the last trimester of pregnancy, most women experience substantial pressure and discomfort, including lower back and/or mid-back discomfort and an unbalanced sensation. As a result of such discomfort and unbalanced sensations, a pregnant woman's posture can deteriorate and her desire to remain active and to exercise may be inhibited. That, in turn, can lead to excessive weight gain and other problems associated with inactivity during pregnancy.

Heretofore, pregnant women have attempted to temporarily alleviate such discomfort by supporting the abdomen with clasped hands and, more recently, by the use of maternity support pantyhose. Undergarments used for support purposes during pregnancy are also well-known in the prior art. Many types of support undergarments have been devised, for example, undergarments in the form of abdominal supports, girdles, body garments and the like. Typically, the prior art undergarment devices include an abdominal pouch or panty-like girdle used in conjunction with shoulder straps or a waistband to envelope the abdomen and provide a measure of abdominal support for the wearer.

In the case of the known panty-like or body girdles, such as those disclosed, for example, in U.S. Pat. Nos. 3,357,435; 4,557,268; and 4,697,592, there is a disadvantage in that such garments must be removed during elimination of body wastes and during medical examinations, such as pelvic examinations. A primary function of such prior art undergarments is to restrain and compress the abdomen, hips and buttocks with an elastic-like material, such as Spandex, Lycra knit or other stretchable fabric. This type of support undergarment may make the wearer uncomfortable, especially if the pressure exerted by the undergarment becomes excessive which is most likely in the later stages of a pregnancy.

Other types of prior art undergarments, such as those disclosed in U.S. Pat. Nos. 1,068,268; 1,828,015; 3,273,563 and 4,596,253, avoid some of the aforementioned problems with the girdle-like support undergarments. However, these prior arts undergarments still employ a relatively large abdominal pouch which envelopes and encloses a substantial portion of the abdomen. Several of these undergarments include waist and shoulder support straps, but do not include sufficient support for the lower back and the mid-back nor any support for the breasts.

SUMMARY OF THE INVENTION

In view of the foregoing limitations and shortcomings of the prior art support garments, as well as disadvantages not specifically mentioned above, it should be apparent that there still exists a need in the art for a maternity support undergarment which overcomes the problems associated with the prior art devices. It is, therefore, a primary objective of this invention to fulfill that need by providing a maternity undergarment which comfortably supports not only the abdomen, but also the lower back and mid-back, as well as the breasts of a pregnant woman.

More particularly, it is an object of this invention to provide a lightweight, streamlined support undergarment which is remarkably comfortable and readily adjustable to accommodate the physical changes that a woman's body undergoes during pregnancy.

It is another object of this invention to provide a maternity support undergarment which supports the abdomen in a manner similar to the support provided by the clasped hands of a pregnant woman without enclosing the abdomen in a pouch or girdle-like fashion and without involving the hands and arms of the wearer.

Yet another object of the present invention is to provide a maternity support undergarment that need not be removed during elimination of body wastes or during a pre-natal examination, such as a pelvic examination.

Still another object of the present invention is to provide a maternity support undergarment which is designed to distribute the abdominal load over a substantial part of the wearer's body including the shoulders, torso, back and waist.

Another object of the present invention is to provide a maternity support undergarment in which the load of the abdomen and breasts of the wearer are supported in a manner to provide a counterbalancing of those loads.

Briefly described, the foregoing and other objects of the invention are accomplished in accordance with the invention by providing an adjustable maternity undergarment that cooperates with the body of the wearer to comfortably support the abdomen in a more natural manner and provides support for the lower back and the mid-back, as well as the breasts. The undergarment comprises a back panel adapted to extend approximately from the shoulders to the hips. A first pair of integral straps (torso straps) extends substantially horizontally from opposite sides of the back panel around the wearer in the region of the bustline. Each of the first pair of straps is formed adjacent its end with a respective brassiere cup and the free ends of such straps are provided with fastening means for securing the brassiere cups together between the breasts of the wearer.

A second pair of integral straps (shoulder straps) extends from the opposite upper corners of the back panel upwardly and outwardly over the shoulders of the wearer. Each strap of the second pair of straps connects with a respective one of the first pair of straps adjacent a respective brassiere cup. A third pair of integral straps (waist straps) extends from the opposite lower corners of the back panel approximately at the waistline of the wearer and downwardly therefrom over the hips and around the wearer. The ends of the third pair of straps are adjustably secured to the opposite ends of an abdominal support sling or strap which engages the lower abdomen of the wearer and provides uplifting support to the abdomen.

The back panel and three pairs of straps are preferably formed in one piece of a washable fabric, such as a relatively heavy cotton fabric. The brassiere cups may be formed of the same cotton fabric material integrally with the first pair of straps, but are preferably formed of a conventional support-type material, such as an expandible support fabric sewn to the ends of the first strap pair. The abdominal support sling is preferably formed of a similar expandible fabric and has a width of about 4 to 5 inches. In a preferred form of the invention, the back panel is also provided with an insert of expandible support material in the lower region thereof adjacent the location of the lower back of the wearer. Such support insert may have any suitable shape, such as a four-sided, diamond shape.

In use, the maternity support undergarment provides support for the most common areas of discomfort a woman experiences during pregnancy. The back panel is the structural member which provides support for the lower back and the mid-back, particularly in the lower back where the support insert is preferably located. Uplifting abdominal support is provided by the abdominal support sling which is adjustable on both sides for comfort with the third strap pair. The abdominal load supported by the sling is distributed to the back panel by the third (waist) pair of straps in a manner that simulates the natural support provided when a pregnant woman supports her abdominal weight by clasping her hands about her lower abdomen. The advantage of the inventive arrangement over such naturally provided support is that the abdominal load is carried to a great extent by the shoulders, upper torso and back of the wearer and the hands and arms are free for other tasks.

The increased load exerted on the shoulder straps by the back panel also tends to urge the wearer's shoulders rearwardly thus improving posture and helping to minimize back discomfort caused by poor posture. The shoulder and torso straps and the respective brassiere cups support the wearer's breasts from the back panel. Advantageously the respective body loads supported by the abdominal support sling on the one hand and the brassiere cups on the other hand are to a large extent counterbalanced by one another and distributed over the back panel of the support undergarment of the invention.

With the foregoing and other objects, advantages and features of the invention that will become hereinafter apparent, the nature of the invention may be more clearly understood by reference to the following detailed description of the invention, the appended claims and the several views illustrated in the accompanying drawings.

BRIEF DESCRIPTION OF THE DRAWINGS

FIG. 1 is a front perspective view of the maternity support undergarment of the present invention;

FIG. 2 is a rear perspective view of the maternity support undergarment of the invention;

FIG. 3 is a side view of the maternity support undergarment illustrated in use by a pregnant woman; and FIG. 4 is a rear view of the maternity support undergarment illustrated in use by a pregnant woman.

DESCRIPTION OF A PREFERRED EMBODIMENT

Referring now to the drawings, there is illustrated in FIGS. 1–4, the maternity support undergarment of the present invention which is designated generally with reference numeral 10. Undergarment 10 comprises a back panel 12 which extends generally from about the shoulders to about the waist of the wearer (FIG. 4) and covers a substantial portion of the back of the wearer, especially the central region of the back on either side of the spine of the wearer. The back panel 12 has two upper corners, two lower corners and an intermediate portion. The back panel 12 further has two side edges extending between a respective upper and lower corner, each side edge being gradually inwardly contoured toward the other from the upper corner to the intermediate portion and from the lower corner to the intermediate portion each that the narrowest side-to-side dimension of the back panel 12 is located at the upper and lower corners thereof and the widest side-to-side dimensions of the back panel 12 are located at the upper and lower corners thereof.

A first pair of torso straps 14,16 extends substantially horizontally from the approximate mid-point of the back panel 12 on each side thereof and around the torso of the wearer just beneath the armpits. The torso straps are connected at their extremities by sewing or other suitable means to a respective brassiere cup 18,20 made to correspond to a standard bra cup size. As best seen in FIG. 1, the brassiere cups 18,20 are removably fastened together by means of a conventional fastener 22 located between the breasts of the wearer.

A second pair of straps 24,26 extends from the upper corners of the back panel 12 upwardly and outwardly over the shoulders of the wearer and are removably fastened to the extremities of the torso straps 14,16 adjacent the brassiere cups 18,20 by means of conventional fasteners 28,30. Straps 24,26 are adjustable in length by conventional adjustment means 32,34.

A third pair of straps 36,38 extends from the lower corners of the back panel 12 around the waist of the wearer and downwardly over the hips toward the lower abdomen. Each strap 36,38 is connected at its extremity by adjustable means 42,44 to an abdominal support strap 40 which encircles the lower abdomen.

The abdominal support strap 40 and the brassiere cups 18,20 are preferably made of a conventional support-type expansible material. The panel 12 is preferably provided in the lower back region thereof with an insert 46 also made of a conventional expansible support material. A preferred shape of the insert 46 is a four-sided, diamond shape as shown in FIG. 4.

The back panel 12 and straps 14,16,24,26,36 and 38 are preferably made of a strong washable fabric, such as a relatively heavy cotton material. The back panel 12 is preferably contoured as shown in FIG. 4 although other shapes of the back panel are possible within the contemplation of the invention.

The advantages of the maternity support undergarment of the invention are apparent from a consideration of the drawings and the above description thereof. As best shown in FIG. 3, the waist straps 36,38 and sling 40 extend downwardly beneath the lower abdomen and support the abdomen along substantially the same natural line or direction that the wearer's forearms would extend if the hands were clasped at the location of the sling 40. The body load carried by the sling 40 and straps 36,38 is distributed to the lower pairs of the back panel 12, including the support insert 46, and to the upper part of the back panel, including the shoulder straps 24,26 and torso straps 14,16. The body load carried by the brassiere cups 18,20 is transmitted to the shoulder straps 24,26 and torso straps 14,16 and, as best seen in FIG. 3, helps to counterbalance the body load carried by the sling 40 and improves the posture of the wearer.

Advantageously, the wearer may, if desired, wear a conventional bra beneath the undergarment 10 as well as the usual panty 50 so that the undergarment 10 may be removed without removing those other undergarments. It is also within the contemplation of the invention that other forms of conventional fastening and adjusting means may be used in lieu of those shown in the drawings. For instance, Velcro-type fasteners and adjustment means may be substituted for those described above.

Although certain presently preferred embodiments of the invention has been described herein, it will be apparent to those skilled in the art to which the invention pertains that variations and modifications of the described embodiment may be made without departing from the true spirit and scope of the invention. Accordingly, it is intended that the invention be limited only to the extent required by the appended claims and the applicable rules of law.

What is claimed is:

1. A maternity support garment for supporting the lower abdomen, breasts and lower back of a pregnant woman comprising:

a back panel having two upper corners, two lower corners and an intermediate portion, said back panel further having two side edges extending between a respective upper and lower corner, each side edge being gradually inwardly contoured toward the other from the upper corner to the intermediate portion and from the lower corner to the intermediate portion such that the narrowest side-to-side dimension of the back panel is located at the intermediate portion thereof and the widest side-to-side dimensions of the back panel are located at the upper and lower corners thereof;

a pair of brassiere cups;

a first pair of straps extending from the opposite side edges of the intermediate portion of the back panel at the narrowest side-to-side dimension thereof, each strap being connected to a respective brassiere cup and being adapted to pass about the torso of the pregnant woman such that said brassiere cups provide support for the breasts of the pregnant woman;

a second pair of straps extending from the upper corners of the back panel and being adapted to pass over the shoulders of the pregnant woman;

means for connecting a respective one of the second pair of straps to a respective one of the first pair of straps;

an abdominal support sling; and a third pair of straps connected to the back panel at the lower corners thereof and spaced from the intermediate portion thereof, said third pair of straps adjustably connecting the abdominal support sling to the back panel for supporting the lower abdomen of the pregnant woman.

2. The maternity support garment of claim 1, wherein said abdominal support sling is fabricated of a support fabric in the form of a band having a uniform width of 4–5 inches for supporting the lower abdomen of the pregnant woman.

3. The maternity support garment of claim 1, wherein said first, second and third pairs of straps are integrally formed in one-piece with the back panel.

4. The maternity support garment of claim 1, wherein said abdominal support sling is a unitary, one-piece band having only two ends, each end of said band being releasably and adjustably connected to a respective third strap.

5. The undergarment according to claim 1, including means for releasably fastening the brassiere cups to one another, and means for adjusting the length of the second pair of straps.

6. The undergarment according to claim 1, wherein said back panel comprises a cloth fabric having a back support insert, said back support insert being located at a lower portion of the back panel for supporting the lower back of the wearer.

7. The undergarment according to claim 6, wherein said back support insert is diamond shaped.

8. The undergarment according to claim 1, wherein said means for connecting the second straps to the first straps comprises releasable fasteners.

9. The undergarment according to claim 1, wherein said back panel and said first, second and third pairs of straps are fabricated of a cotton fabric.

10. The undergarment according to claim 1, wherein the straps of said second pair of straps are connected to said back panel at laterally spaced points and extend upwardly and outwardly from the upper corners of the back panel, and wherein the straps of said third pair of straps are connected to said back panel at laterally spaced points and extend downwardly and outwardly from the lower corners of the back panel.

11. The undergarment according to claim 9, wherein said brassiere cups are fabricated of an expandible support fabric.

12. The undergarment according to claim 1, including means for adjusting the length of the third pair of straps whereby the degree of support provided by the abdominal support sling can be adjusted to the comfort of the wearer.

* * * * *